US006403955B1

(12) United States Patent
Senko

(10) Patent No.: US 6,403,955 B1
(45) Date of Patent: Jun. 11, 2002

(54) LINEAR QUADRUPOLE MASS SPECTROMETER

(75) Inventor: Michael Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 09/559,245

(22) Filed: Apr. 26, 2000

(51) Int. Cl.[7] ..... H01J 49/42
(52) U.S. Cl. ..... 250/292; 250/290
(58) Field of Search ..... 250/292, 290, 250/299, 300

(56) References Cited

U.S. PATENT DOCUMENTS

| | | | | |
|---|---|---|---|---|
| 4,755,670 A | | 7/1988 | Syka et al. | 250/292 |
| 5,625,186 A | | 4/1997 | Frankevich et al. | 250/292 |
| 5,783,824 A | | 7/1998 | Baba et al. | 250/281 |
| 5,886,346 A | * | 3/1999 | Makarov | 250/290 |

OTHER PUBLICATIONS

Soni, Manish et al., "Broad–Band Fourier Transform Quadrupole Ion Trap Mass Spectrometry", *Anal. Chem.* 1966, 68, 3314–3320.

Jungmann, K., et al. "Collective oscillations of stored ions", *Physical Review A*, vol. 36, No. 7 (Oct. 1, 1987) 3451–3454.

Badman, Ethan R., et al., "Differential Non–Destructive Image Current Detection in a Fourier Transform Quadrupole Ion Trap", Proceedings of the 1999 ASMS Conference.

Aliman, M. and A. Glasmachers, "A Novel Electric Ion Resonance Cell Design with High Signal–to–Noise Ratio and Low Distortion for Fourier Transform Mass Spectrometry", *J Am Soc Mass Spectrom* 1999, 10, 1000–1007.

Arkin, C. Richard and D.A. Laude, "An Ion Trap Design for Fourier Transform Analysis", Proc. 45th ASMS Conference on Mass Spectrometry and Allied Topics, Jun. 1–5, 1997, Palm Springs, California.

* cited by examiner

*Primary Examiner*—Kiet T. Nguyen
(74) *Attorney, Agent, or Firm*—Flehr Hohbach Test Albritton & Herbert LLP

(57) ABSTRACT

A quadrupole ion trap mass analyzer in which the trapping volume is defined by spaced linear rods in which linear elements located between the spaced linear rods produce image currents produced by motion of ions in the trapping volume.

13 Claims, 9 Drawing Sheets

LINEAR QUADRUPOLE MASS SPECTROMETER

BRIEF DESCRIPTION OF THE INVENTION

This invention relates generally to quadrupole ion trap mass spectrometers and more particularly to a quadrupole ion trap mass spectrometer having an ion volume defined by spaced linear rods in which image currents produced by ion motion in the trapping volume are detected by electrodes located between the spaced rods. The image currents are Fourier analyzed to provide an indication of the mass of the ions in the trapping volume.

BACKGROUND OF THE INVENTION

Fourier transform ion cyclotron resonance mass spectrometers (FT-ICR) have demonstrated many performance capabilities that are of significant analytical value, including high resolution, high mass accuracy and multi-stage mass spectrometry. The primary disadvantage of the FT-ICRs is that they require both magnetic and electric fields. Although the previous difficulties with stray magnetic fringe fields affecting vacuum pumps, electronics and computers, have apparently been solved through the use of actively or passively shielded magnets, this solution is provided at an additional cost over standard superconducting magnets. Furthermore, the size, cost and complications associated with cryogenics produce an instrument that is large, expensive, and difficult to maintain.

The quadrupole ion trap is currently a commercial success because of its sensitivity, low cost and benchtop design. However, the ion trap is being challenged, in terms of performance, by a new generation of benchtop time-of-flight instruments equipped with orthogonal acceleration. Although incapable of MS/MS, these instruments provide high scan rates (10–100 scans/sec), medium resolution (5000–7000 FWHM), and pseudo-accurate mass capabilities when combined with internal standards (2–10 ppm). Improvements are possible to the quadrupole ion trap to bring the mass accuracy to time-of-flight levels, but these results cannot be obtained on a time scale required for chromatographic investigations.

Implementation of a Fourier transform mode of operation on the quadrupole ion trap provides an instrument with the low cost and moderate size, but with the high resolution and mass accuracy of the FT-ICR. Based on the current ion trap sizes (7–10 mm) and RF electronics (17kV p-p), frequency dispersions equivalent to very high magnetic fields (>10T) can be produced with a small benchtop instrument. The large frequency dispersion can be exploited to increase either the scan rate or the resolving power of the ion trap.

The major obstacle to operating the quadrupole ion trap in Fourier transform mode is the need to detect uV-level image signals from the trapped ions in the presence of feedback from the kV trapping field. The first demonstration of operating a quadrupole ion trap in FT mode was by Syka (U.S. Pat. No. 4,755,670: Fourier Transform Quadrupole Mass Spectrometer and Method). It was demonstrated that with appropriate filtering and nulling of the RF signal, ion signals could be detected over a narrow mass range. However, the detection sensitivity was relatively poor, and the ion densities required for obtaining useful signal caused significant ion coupling.

Frankevich et al., U.S. Pat. No. 5,625,186 describe an ion trap mass spectrometer of the type having an ion trapping volume defined by spaced end caps and a ring electrode. The ion trap includes a small sensing electrode, which senses characteristic motion of ions trapped in said trapping volume and provides an image current. Ions are excited into characteristic motion by application of an excitation pulse to the trapped ions. The pin picks up a fraction of the ion image current, while the end cap shields the pin detector from the RF and reduces capacitive pickup. The elimination of the filtering and nulling circuitry improves the detection sensitivity significantly so that reduced ion densities can be used to separate ions and enable detection of signals over a broader mass range. This original system has recently been improved by the use of differential detection, which reduces background noise while also increasing signal and simultaneously minimizing the effects of ghost-peaks created by non-sinusoidal image current pickup.

Another approach to reduce the coupling of the RF trapping field to the detection circuit is described by Aliman and Glasmachers "A Novel Electric Ion Resonance Cell Designed with High Signal-to-Noise Ratio and Low Distortion for Fourier Transform Mass Spectrometry" (*J. Am. Soc. Mass Spectrom.* (1999) 10, 1000–1007). By using a segmented cylindrical ring electrode and capacitive shimming, the feedback from the ring electrode was significantly reduced. Initial results using single-ended detection are similar in signal-to-noise and resolving power as that demonstrated by the Frankevich et al.

Although further improvements are expected with these instruments, they have yet to produce analytically useful signals at ion densities which eliminate ion coupling.

OBJECTS AND SUMMARY OF THE INVENTION

It is an object of the present invention to provide a Fourier transform linear quadrupole ion trap having an electrode geometry which minimizes the trapping field feedback.

It is another object of the present invention to provide a linear quadrupole ion trap having a large useful ion trapping volume.

It is a further object of the present invention to provide an ion trap for a Fourier transform mass spectrometer which has low field distortion.

There is provided an ion trap mass spectrometer of the type which includes a trapping volume defined by a quadrupole structure including spaced linear quadrupole rods in which ions can be trapped by application of RF and DC voltages to the rods. Independent image current electrodes are disposed between said quadrupole rods to detect image currents in response to movement of ions trapped in said trapping volume by application of an excitation voltage which causes the ions to move towards and away from said image current electrodes to generate image currents.

BRIEF DESCRIPTION OF THE DRAWINGS

The foregoing and other objects of the invention will be more clearly understood from the following description when read in conjunction with the accompanying drawings in which.

DESCRIPTION OF PREFERRED EMBODIMENTS(S)

A Fourier transform linear quadrupole mass analyzing device using a two-dimensional quadrupole field can be implemented using an octopole device in which four of the rods have RF voltages applied to establish an ion trapping field in the radial direction and others of the rods can be used to generate image currents responsive to motion of the trapped ions.

Figure 1:
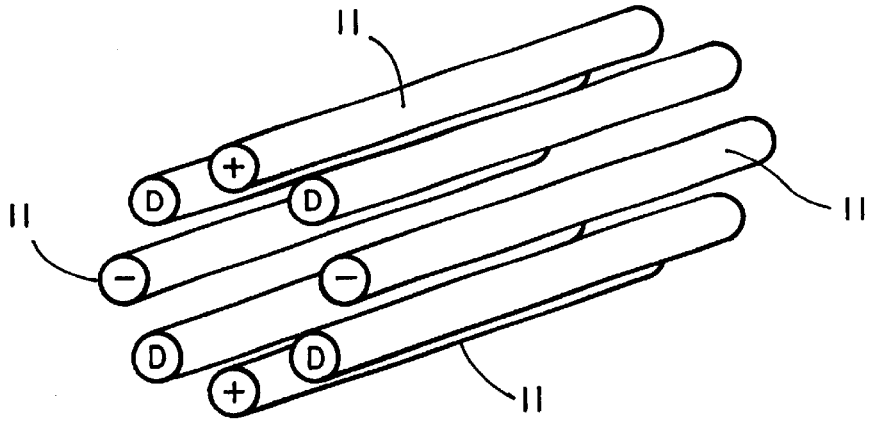
FIG. 1 schematically shows a linear quadrupole mass spectrometer with spaced linear trapping rods and image current detection rods.
Figure 2:
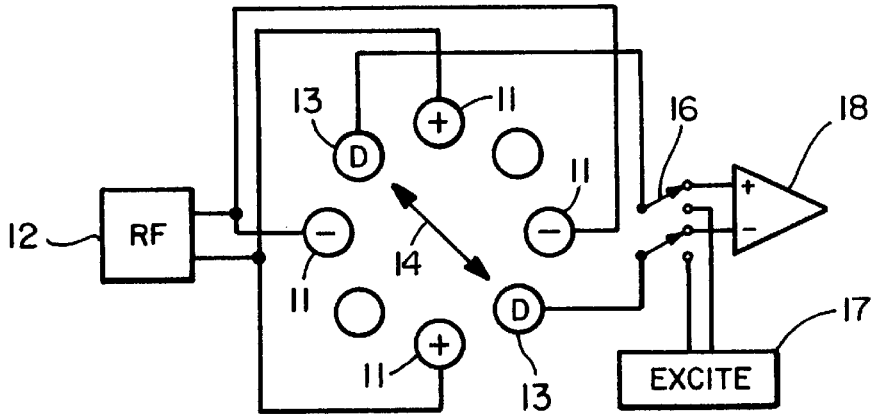
FIG. 2 is an end view of the mass spectrometer of FIG. 1 illustrating the application of RF trapping voltages, excitation voltage and image current detection.
Figure 3:
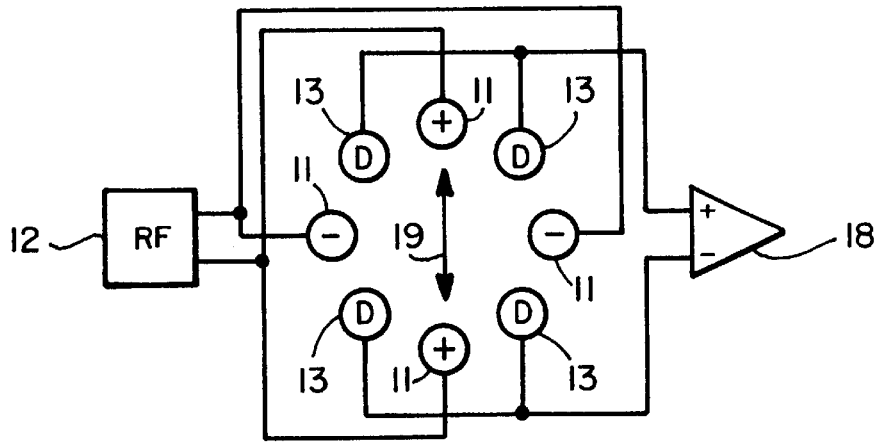
FIG. 3 is an end view of another image current detection arrangement.
Figure 4:
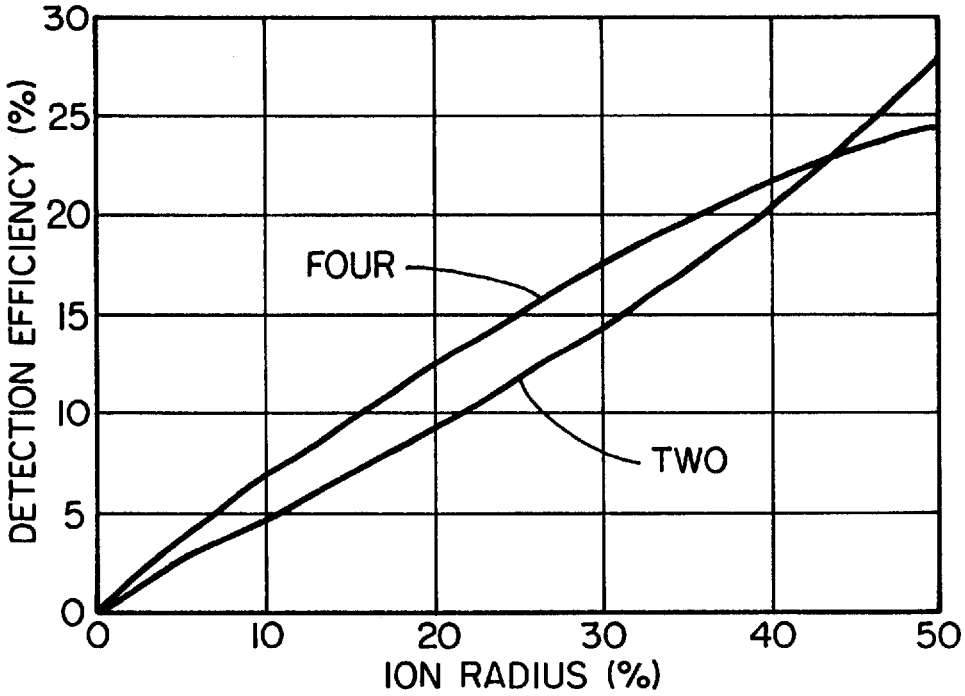
FIG. 4 shows the detection efficiency as a function of ion excitation radius for the two and four detectors shown in FIGS. 2 and 3 respectively.

Referring to FIGS. 1, 2 and 3, four of the linear octopole rods 11 are connected to receive RF trapping voltages from the supply 12. In FIG. 2, two of the other rods 13 are connected to receive an excitation pulse which will cause the stored ions to oscillate in the direction of the arrows 14. Relay 16 is used to switch from a pulse excitation source 17 to a receiver 18. A disadvantage with the use of relays is that, without careful design and construction, they will add noise and additional capacitance to the signal path, which will reduce sensitivity. In FIG. 3, all four of the other rods 13 are connected to detect image currents. The excitation pulse is applied to two of the RF rods 11. This causes the ions to oscillate in the direction designated generally by the arrow 19. FIG. 4 shows the detection efficiency as a function of the ion excitation radius for the two- and four-rod detection connections shown in FIGS. 2 and 3, respectively.

Figure 5:
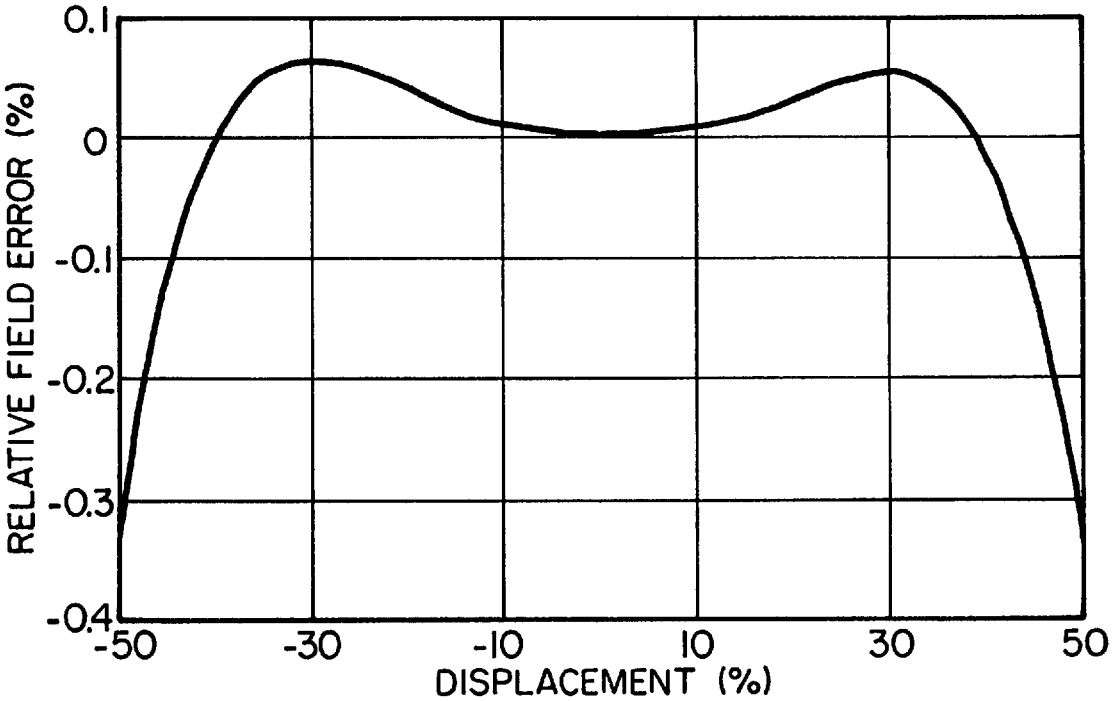
FIG. 5 shows the field purity as a function of displacement from the center of the ion trap of FIG. 1.

The linear octopole device has an excellent field purity out to a displacement from center of more than 50%, FIG. 5, which provides acceptable detection efficiency. However, it is not known how field purity will affect performance of a linear quadrupole ion trap operated in Fourier transform mode. An impure quadrupolar field will produce ion excitation radius-dependent frequencies. However, small clouds of ions and low pressure, which minimize collisional damping, should still produce time-domain signals free of observable frequency shifts.

The relative size and position of the RF and detection rods influence the field purity. Investigation into the relative detection rod sizes, and their relative placements from center, showed that smaller detection rods produce a purer quadrupole field. This is quite intuitive considering the detection rods sit on a ground plane between the adjacent RF rods, and the disturbance of this ground plane is the primary contribution to field inhomogeneities. Obviously, infinitely small detection rods will produce the purest field; however, they will sacrifice detection sensitivity because of their inability to capture image current. The relative position of the detection rods also influences field purity. Rods that are further from the center of the trap will produce minimal field disturbances, but will also provide reduced signal. Rods that are close to the center will produce poor fields, but will provide the best signal.

Figure 6:
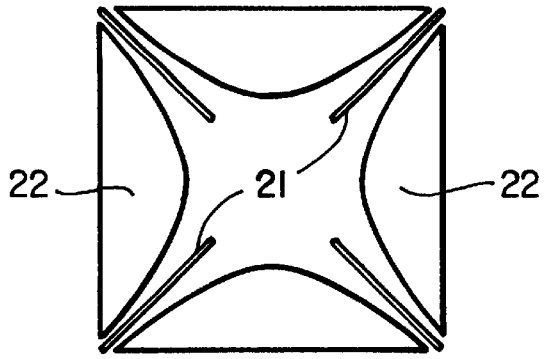
FIG. 6 is an end view of an ion trap mass spectrometer having maximum field purity.
Figure 7:
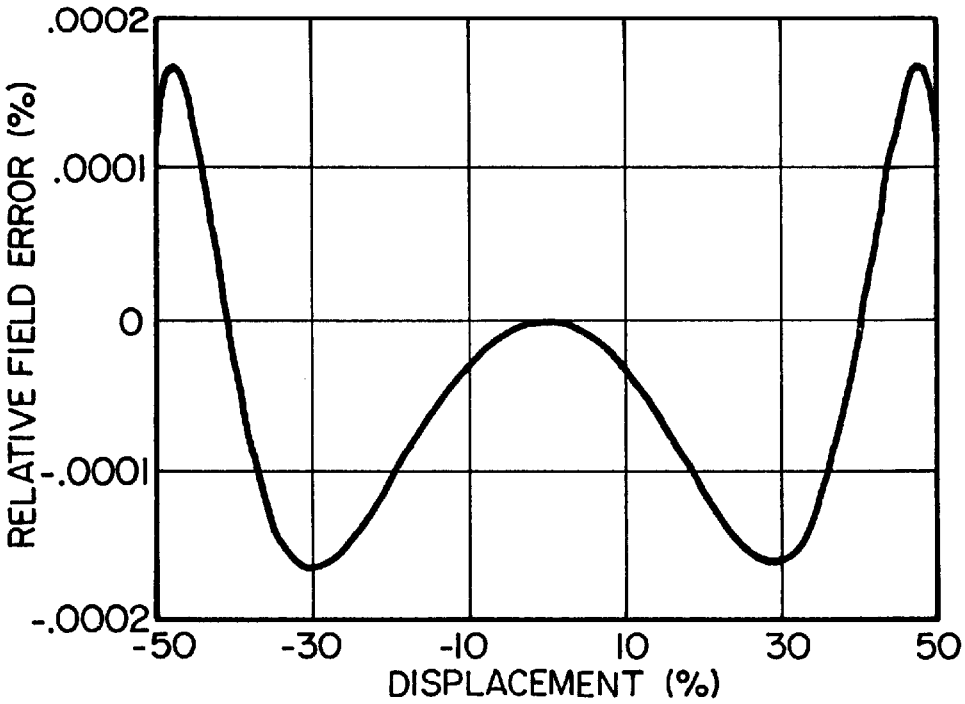
FIG. 7 shows the field purity as a function of displacement from the center of the ion trap of FIG. 6.
Figure 8:
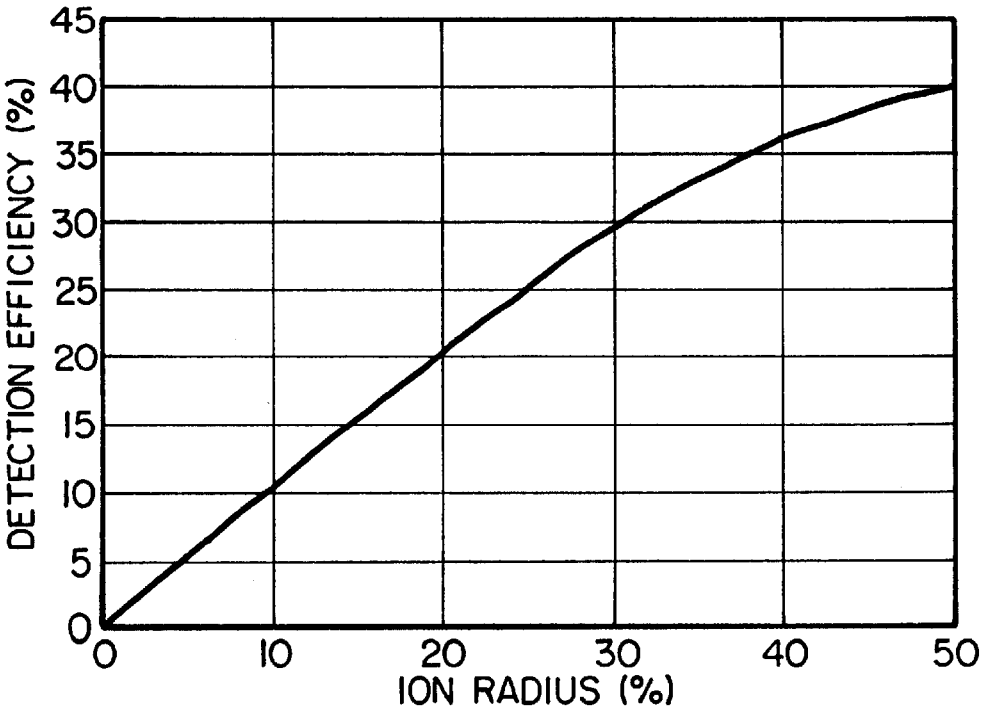
FIG. 8 shows the detection efficiency for four detectors as a function of ion excitation radius for the ion trap of FIG. 6.

In one example, in order to maximize field purity without sacrificing detection efficiency, the detection rods or electrodes were replaced by thin (300 $\mu$m) detection plates 21, FIG. 6, placed on the ground planes between distorted hyperbolic rods 22. The distortion of the hyperbolic rods served to correct the inhomogeneities produced by the detection plates. This device was capable of producing a field that was pure to a few ppm, as shown in FIG. 7, while still producing detection efficiencies of ~40%, FIG. 8. However, to obtain this field purity, the device needs to be constructed with exacting precision. Holding the thin detection plates towards the center of the device in an exact position, while creating the distorted hyperbolic profile, is extremely difficult.

Figure 9:
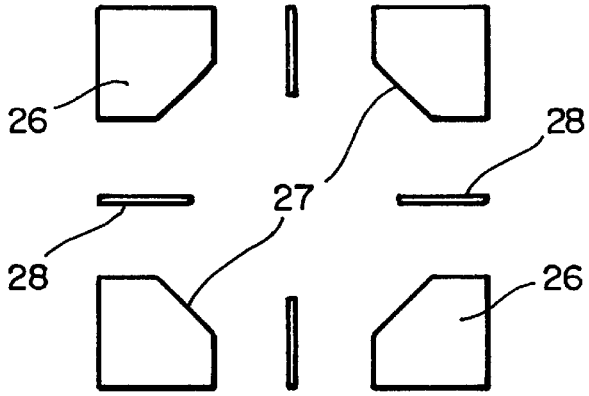
FIG. 9 is an end view of an ion trap mass spectrometer which was constructed and tested.
Figure 10:
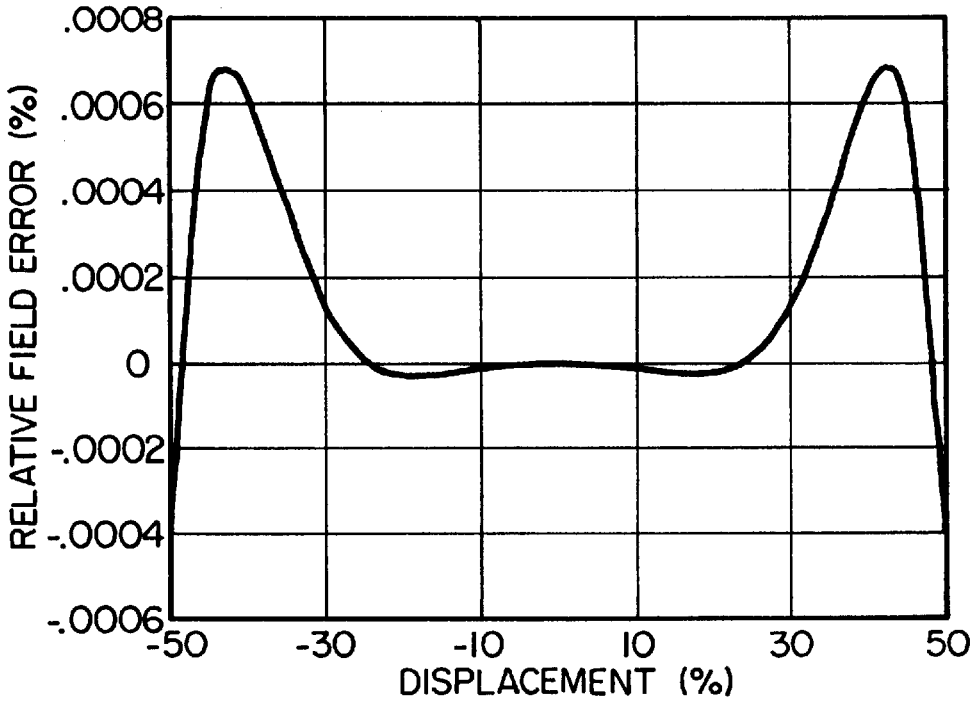
FIG. 10 shows the field purity of the ion trap of FIG. 9 as a function of displacement from the center of the ion trap.
Figure 11:
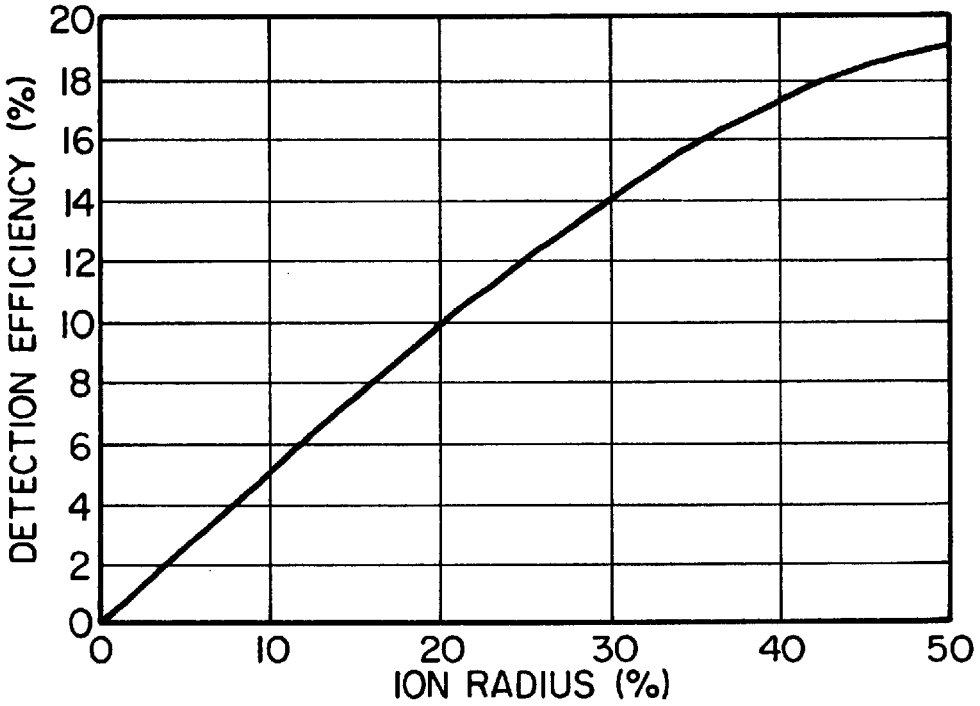
FIG. 11 shows the detection efficiency for four detectors as a function of ion excitation radius for the ion trap of FIG. 9.

Modification of this device led to the device shown in FIG. 9 which was used to conduct the experiments to be described. The scale of the device had a radius $r_0$ of 20 mm to minimize the effect of errors in construction. The RF rods 26 had flat surfaces to simplify manufacturing. By applying the proper bevel 27, a very pure field was created in the inner 50% of the device, as shown in FIG. 10. The detection plates 28 were thickened to 1.4 mM to provide better structural support, while they were also pulled back from the center of the trap to compensate for the inhomogeneity added because of their thickness. This produced 20% efficient detection, FIG. 11. The electrodes were held in position and insulated by quartz blocks and glued with high-vacuum compatible adhesive. In the experimental linear ion trap, electrodes were positioned accurately only to about 200 $\mu$m.

Figure 12:
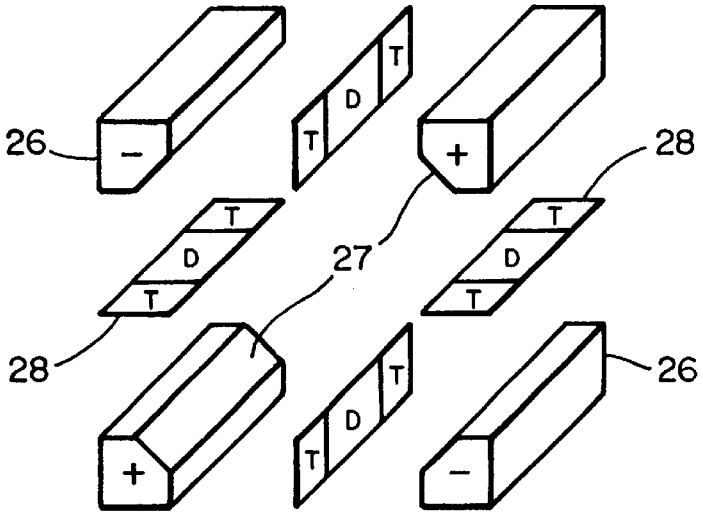
FIG. 12 is a schematic perspective view of the ion trap of FIG. 9 showing segmentation of the detection elements for trapping.

The ion trap just described will contain ions in the x and y directions, but ions will be free to move in the z direction. The simplest solution for ion containment is to place perpendicular plates on the end of the device, but ions will then see a region of fringing RF, which would cause undesirable effects. U.S. Pat. No. 4,755,670, incorporated herein by reference, suggests segmenting the RF rods to prevent the ions from seeing fringing fields. It was decided, for the present embodiment, to simplify the construction and to split only the detection electrodes into three segments with 1-inch ends and 4-inch centers go that the end segments can be floated slightly above ground to contain the ions in the z direction, FIG. 12.

Figure 13:
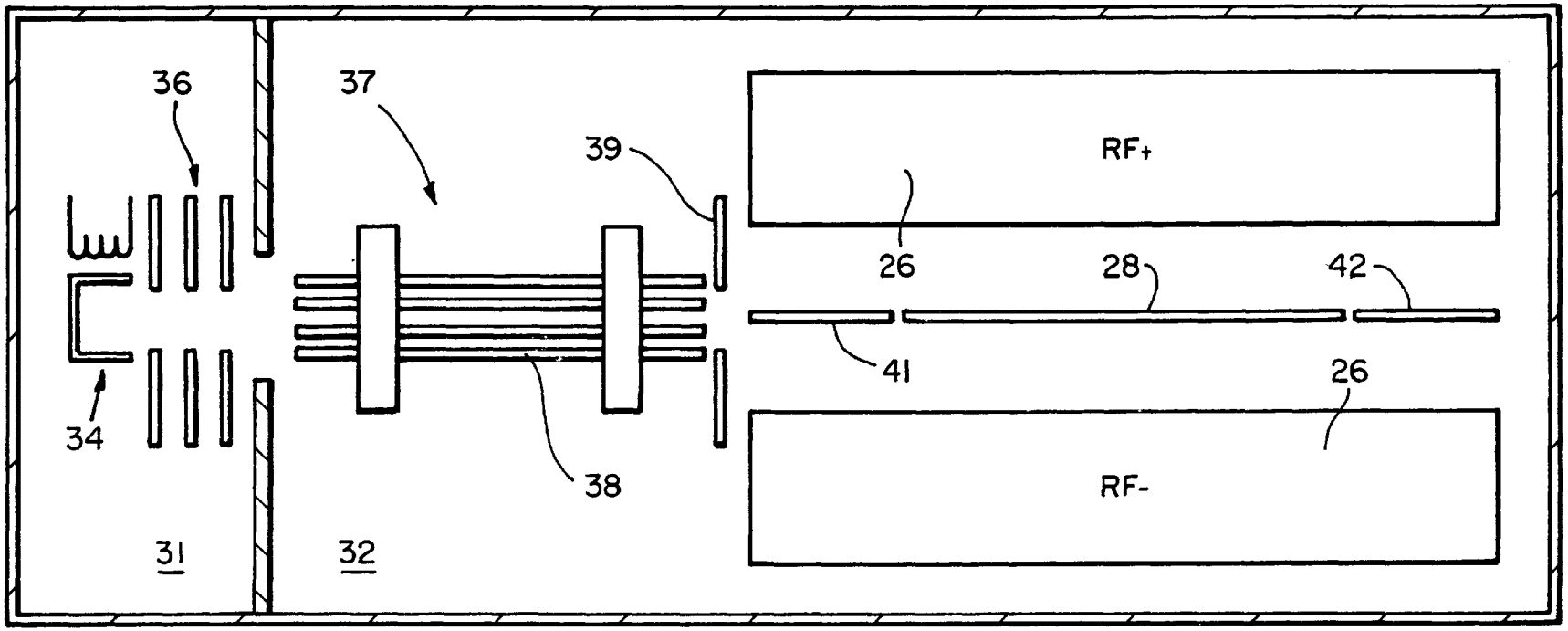
FIG. 13 is a schematic view of a complete mass spectrometer in accordance with one embodiment of the present invention.

The linear ion trap, FIG. 13, was placed in a vacuum system on a cradle which included an optical rail (not shown). The system was evacuated to bring the ion source and analyzer chambers 31 and 32 to pressures on the order of $10^{-5}$ torr for the source chamber 31 and $10^{-7}$ for chamber 32. The ion source included an electron gun assembly 34 and three lenses 36 for directing ions into a short octopole storage trap 37. By applying suitable RF trapping voltages to the octopole rods 38, and dc voltages to the trapping lens 39, ions are accumulated in the octopole storage trap 37. The ions were then transferred into the analyzing trap by changing the dc voltages applied to the trapping lens 39, while applying RF ion trapping voltages to the RF rods 26 of the analyzer ion trap. Trapping voltages were applied to the end segments 41 and 42 of the detection elements 28.

Figure 14:
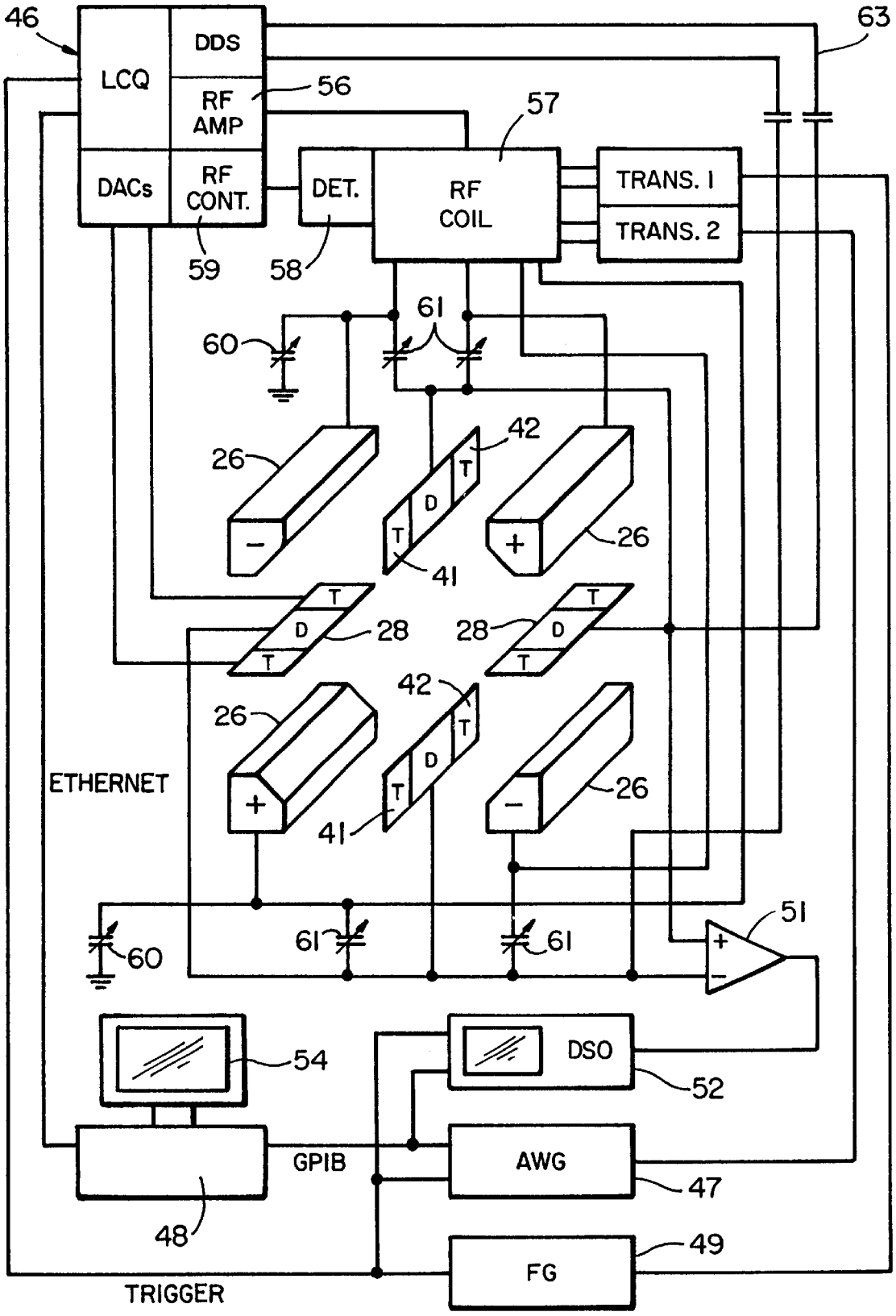
FIG. 14 shows the ion trap mass spectrometer connected to control and detection circuits.

FIG. 14 shows the electronic control circuits connected to the linear ion trap. Primary control of the instrument was performed with the electronic circuits 46 used in the LCQ Mass Spectrometer System sold by Finnigan Corporation. The LCQ circuits generate analog voltages and trigger voltages using customized scan matrices. Excitation of the ions was produced by an Analogic arbitrary waveform generator (AWG) 47 controlled by a General Purpose Interface Bus (GPIB) from a 120 MHz computer 48. Pulsed excitation was produced by a Wavetek function generator 49. Detection was performed by a preamplifier 51 which was fed to a Tektronix storage oscilloscope 52. Data was transferred from the storage oscilloscope by GPIB to the computer where it was processed and displayed in the display 54 by custom software written with Borland $C^{++}$ Builder. This software also controlled the waveform parameters for the AWG. The ionizing filament current was supplied in an unregulated fashion by a floated (−70 V) Lambda power supply.

RF was generated with the LCQ RF amplifier 56. This signal was fed to an RF coil box 57 with a custom center-tapped, trifilar (one wire for each excitation phase, and one wire for RF detection) coil with 100 total turns. The RF level was detected by standard detection circuitry 58, and the level signal was fed back to a detector board 59 which controlled the RF amplifier. The RF levels on the rod sets were matched to better than 1% by adjustable capacitors 60. The system was run at 530 kHz, and later at 785 kHz by removing half the turns from the RF coil. Unequal RF levels on the different rods, and mismatched capacitance between the rods and detector plates, produced RF feedback to the detector plates which saturated the preamplifier. RF feedback was reduced by using variable high-voltage capacitors 61. Each phase of the RF was connected to each leg of the detection system through two 2–10pF variable capacitors 61. By proper adjustment of the capacitors, the feedback was reduced to approximately 20 mV on each channel when 1 kV of trapping field was applied to the RF electrodes. The remaining RF could not be shimmed out using this passive method because it was due to slight phase shifts between the initial feedback signal and the shim signal.

Although this last 20 mV could probably be reduced to acceptable levels using a phase shifter, it was instead reduced on each channel to acceptable levels by feeding back a signal 63 from the LCQ that was phase locked, but independent of, the RF signal. The amplitude of this active feedback was controlled by adjusting a variable resistor on a custom amplifier circuit built into the detection preamplifier. Final attenuation from excitation to detection is >120 dB or $10^6$ (<1 mV detected for 1500V applied RF).

Figure 15:
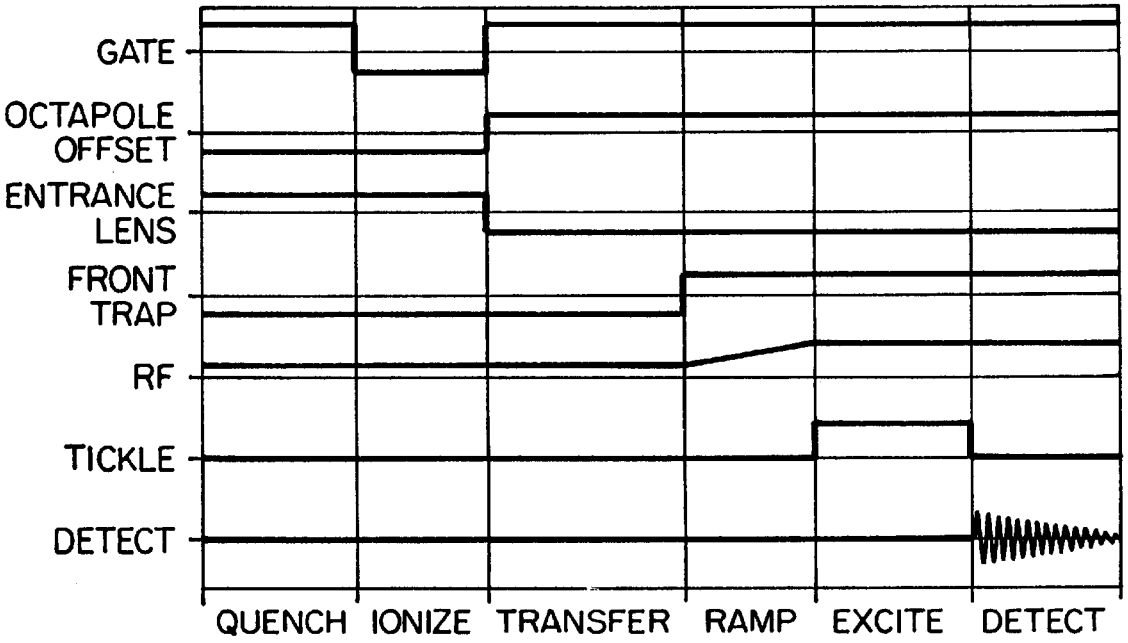
FIG. 15 is a timing diagram showing the sequence of applied voltages.

FIG. 15 is a timing diagram showing voltages applied in the constructed instrument to inject positive ions and measure a mass spectrum. To measure negative ions, all voltage polarities would be reversed. In the first time period, the potential on the front trapping electrodes 41 is reduced to allow ions from the previous measurement to escape. Ions are then gated into the RF multipole trap 37 by reducing a blocking voltage on the central lens of lens stack 36. After accumulating ions in the RF multipole, they are transferred to the quadrupole ion trap by reducing the voltage on the entrance lens 39. To maintain ions in the quadrupole ion trap, the potential on the front trapping electrodes 41 is increased at the end of the transfer period. The RF on the quadrupole ion trap is then ramped up from a low level which is beneficial for injection, to a higher level which optimizes measurement. Ions are then radially excited to amplitudes of approximately 50% of the radius of the trap and then the image current of the ions is measured with the detection electrodes 28.

The first sample to give recognizable results was $CHCl_3$. This compound loses Cl under 70 eV EI conditions to give primarily $CHCl_2^+$. This compound should produce a recognizable triplet from the chlorine isotopic pattern. Initially, spectra were obtained with only a single peak, although resolving power was more than sufficient to separate chlorine isotopes and the signal-to-noise ratio was in excess of 1000:1 for single scans (data not shown).

By allowing the ions to spill out of the end of the linear trap to an electron multiplier, it was determined that there were well in excess of $10^6$ ions during these measurements. Ion coupling was obviously occurring during these conditions due to the high ion densities. By dropping the potential on the trap plates to 1V, approximately 90% of the ions leaked out of the trap, and the chlorine isotopes decoupled.

Figure 16:
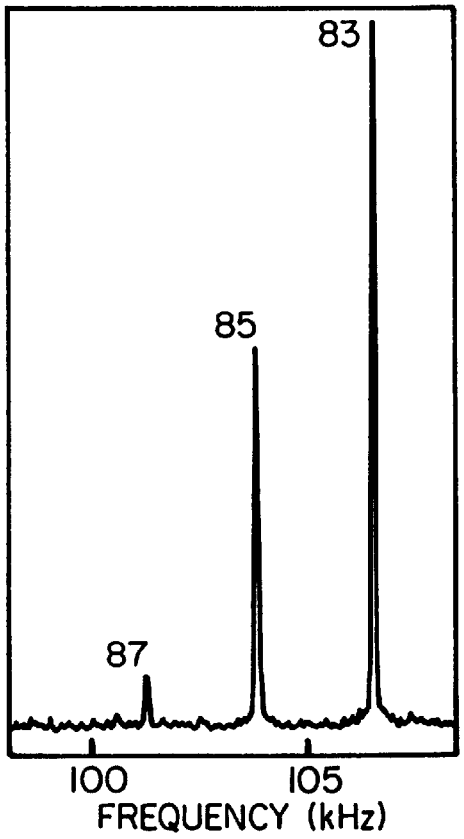
FIG. 16 shows the output of the detection circuit for $CHCl_2^+$ ions after excitation.
Figure 17:
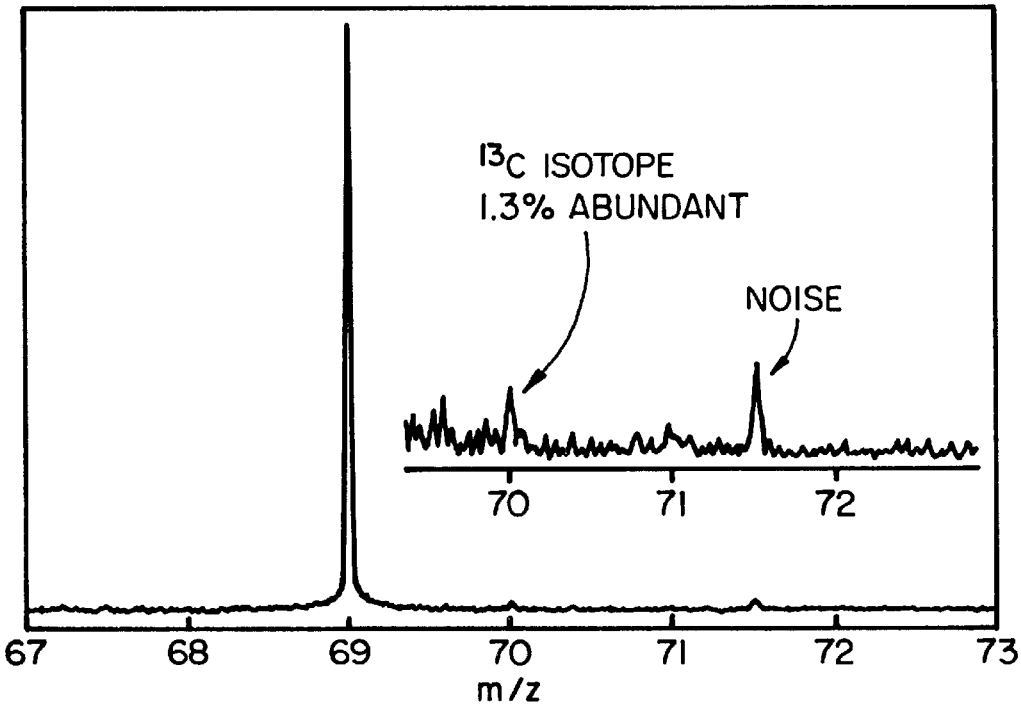
FIG. 17 shows the resolution of adjacent masses of $CF_3^+$ from FC-43.

Based on simple simulations in Simion 6.0 (Lockheed Martin Idaho Technologies Co.) a commercially available ion optics simulation program, it was observed that there is no obvious mechanism by which two ion clouds of similar frequency can pass in a quadrupole ion trap when excitation is performed in only one dimension. The simulations suggested that an initial perpendicular kick preceding the primary excitation would assist ion passing. This was implemented by the addition of a brief, low amplitude square wave (~10V, 5 $\mu$sec) perpendicular to the primary chirp excitation. This perpendicular pulse produced far more accurate isotope ratios for the $CHCl_2$ cluster, FIG. 16. This mode was termed "chaotic excitation" because the motion of the ions varies from a simple plane to cylinder, depending on the relative phase between the perpendicular pulse and the power absorption during the chirp. This mode sufficiently well to resolve peaks of adjacent mass, such as the 69/70 pair of FC-43, FIG. 17; however, coupling could still be observed between these peaks if care were not taken to limit the ion population.

Figure 18:
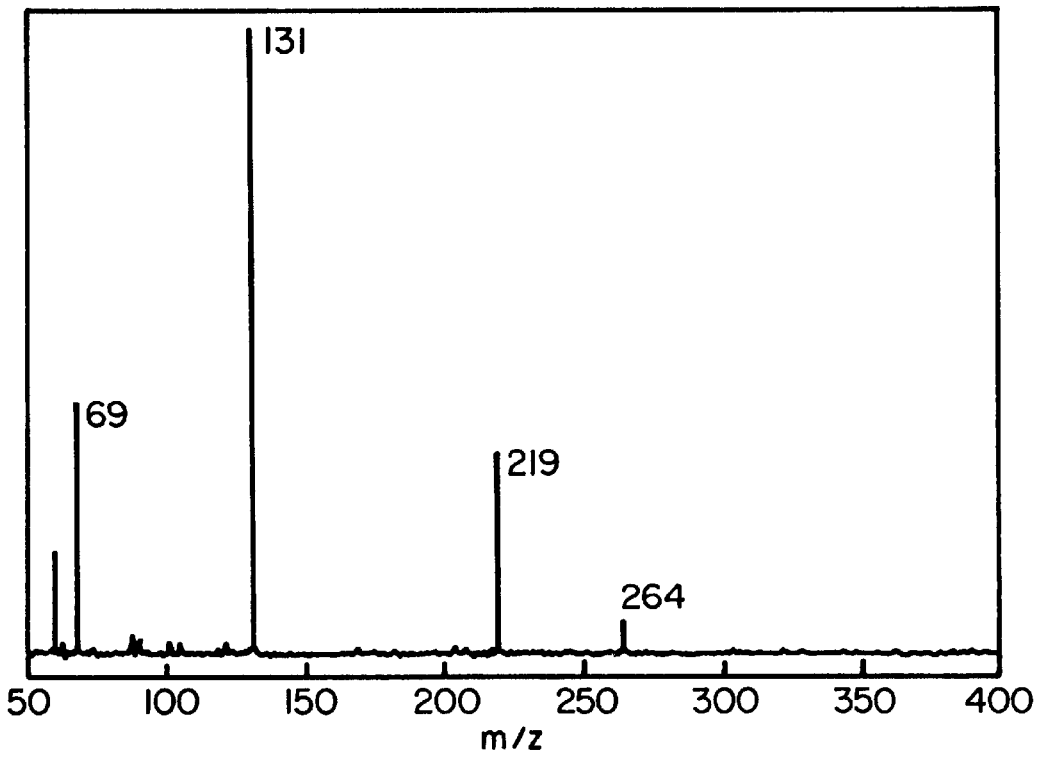
FIG. 18 shows the mass spectrum of FC-43.

The broadband capabilities of the instrument are demonstrated with FC-43, FIG. 18. Resolving power at m/z 69 is 1500 for a 50k point acquisition at 2.5 MHz. By decreasing the acquisition rate to 500 kHz, and thus increasing the observation time, resolving powers in excess of 7000 have been obtained under similar acquisition conditions (data not shown). Peaks are observed from m/z 69 (q=0.45) to m/z 264 (q=0.12), and demonstrate the absence of second harmonics observed on previous single-ended Fourier transform ion traps. By increasing the RF trapping field to ~3 kV p-p, m/z 414 can be observed (data not shown), which is the highest mass obtained so far. However, this is at a loss of all ions below ~m/z 70, which become unstable due to high qs from the increased RF level.

Frequency data were converted to m/z with the empirically determined calibration equation of:

$$m/z=A/f+B$$

where:

m=mass of the ion in daltons z=the charge of the ion

A=an empirically determined constant f=the observed frequency of the ion in Hz

B=and empirically determined constant

For data collected under the same conditions as FIG. 18, the average error using this calibration equation was approximately 0.025 Da for peaks between m/z 100 and m/z 264. This equation was only valid for $q<0.4$, as demonstrated by the m/z 69 peak, which showed a mass error of approximately 0.7 m/z.

Space charge frequency shifts are less problematic on this instrument when compared to data from 3-D ion traps operated in Fourier transform mode, most likely due to the expanded ion volume. When the system is operated at 1.5 kV, m/z 131 is observed at 66 kHz. From near the detection limits up to a 60× increase in intensity, the peak position shifts 66 Hz, or 1000 ppm. This compares with previously published work which shows a 1 kHz shift at 178 kHz for argon when operated over a dynamic range of ~12×.

What is claimed is:

1. A quadrupole mass spectrometer comprising:

a quadrupole structure including equally spaced linear trapping elements arranged to define a trapping volume, four equally spaced linear image current detection elements interleaved between the quadrupole elements, means for applying RF trapping voltages between the quadrupole elements, means for introducing ions into said trapping volume whereby said ion are trapped by quadrupole fields generated by the RF voltages applied to said quadrupole elements, excitation pulse means for applying excitation voltage pulses to one or more of said quadrupole elements or detection elements to cause characteristic motion of trapped ions, and detection means connected to one or more of said image current detection elements for detecting characteristic motion of ions in the quadrupole structure responsive to said excitation voltage pulses.

2. A quadrupole mass spectrometer as in claim 1 in which said four equally spaced linear image current detection elements are in the form of plates mounted substantially near the RF ground plane between the equally spaced linear trapping elements.

3. A quadrupole mass spectrometer as in claim 2 in which the equally spaced linear trapping elements are square rods with facing comers beveled.

4. A quadrupole mass spectrometer as in claim 1 or 2 in which the four spaced linear image current detection elements are split to form a center section for detecting image currents, and shorter end sections to reduce the effects of fringing RF fields at the ends of the detection elements.

5. A quadrupole mass spectrometer as in claim 4 in which the equally spaced linear trapping elements are square rods with facing corners beveled.

6. A quadrupole mass spectrometer as in claim 2 in which the equally spaced linear trapping elements are square rods with facing distorted hyperbolic surfaces.

7. A mass spectrometer comprising:

an ion source, means for introducing ions into a mass analyzer or for forming ions inside of the analyzer, said mass analyzer comprising:

a quadrupole structure including equally spaced linear trapping elements arranged to define a trapping volume, four equally spaced linear image current detection elements interleaved between the quadrupole elements, means for applying RF trapping voltages between the quadrupole elements, means for introducing ions into said trapping volume whereby said ions are trapped by quadrupole fields generated by the RF voltages applied to said quadrupole elements, excitation pulse means for applying excitation voltage pulses to one or more of said quadrupole elements or detection elements to cause characteristic motion of trapped ions, and detection means connected to one or more of said image current detection elements for detecting characteristic motion of ions in the quadrupole structure responsive to said excitation voltage pulses.

8. A mass spectrometer as in claim 7 in which said four equally spaced linear image current detection elements are in the form of plates mounted between the equally spaced linear trapping elements.

9. A quadrupole mass spectrometer as in claim 8 in which the equally spaced linear trapping elements are square rods with facing comers beveled.

10. A quadrupole mass spectrometer as in claim 7 or 8 in which the four spaced linear image current detection elements are split to form a center section for detecting image currents and shorter end sections to reduce the effects of fringing RF fields at the ends of the detection elements.

11. A quadrupole mass spectrometer as in claim 10 in which the equally spaced linear trapping elements are square rods with facing corners beveled.

12. A mass analyzer in which a trapping volume is defined by four spaced linear trapping elements in which ions of predetermined mass-to-charge ratios can be trapped by applications of RF voltages to the linear trapping elements, characterized in that:

four linear image current detection elements are disposed one each between pairs of said linear trapping elements to detect image currents in response to movement of ions in said trapping volume in response to excitation voltages which cause said ions to move toward and away from said detection elements.

13. A mass analyzer as in claim 12 in which said linear image current detection elements are in the form of plates mounted between the spaced linear trapping elements.

* * * * *